US006692242B2

(12) United States Patent
Matsumoto et al.

(10) Patent No.: US 6,692,242 B2
(45) Date of Patent: Feb. 17, 2004

(54) MULTI-CYLINDER ROTARY COMPRESSOR

(75) Inventors: Kenzo Matsumoto, Gunma (JP); Akira Hashimoto, Gunma (JP); Midori Futakawame, Gunma (JP); Masazumi Sakaniwa, Gunma (JP); Hiroyuki Sawabe, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/199,851

(22) Filed: Jul. 19, 2002

(65) Prior Publication Data

US 2002/0182095 A1 Dec. 5, 2002

Related U.S. Application Data

(62) Division of application No. 09/935,815, filed on Aug. 23, 2001, now Pat. No. 6,524,086, which is a continuation of application No. 09/632,877, and a division of application No. 09/632,877, filed on Aug. 4, 2000, now Pat. No. 6,336,799.

(30) Foreign Application Priority Data

Aug. 5, 1999 (JP) ..... 10-22774

(51) Int. Cl.[7] ..... F03C 2/00
(52) U.S. Cl. ..... 418/60; 418/248; 418/63
(58) Field of Search ..... 418/60, 248, 63

(56) References Cited

U.S. PATENT DOCUMENTS 4,712,986 A * 12/1987 Nissen ..... 418/63
5,314,318 A * 5/1994 Hata et al. ..... 418/60
5,470,214 A * 11/1995 Shin et al. ..... 418/63

FOREIGN PATENT DOCUMENTS

JP 53103212 A * 9/1978 ..... F04C/23/00
JP 62-058088 A * 3/1987 ..... F04C/23/00

* cited by examiner

*Primary Examiner*—Thomas Denion
*Assistant Examiner*—Theresa Trieu
(74) *Attorney, Agent, or Firm*—Darby & Darby

(57) ABSTRACT

An object of the present invention is to provide a multi-cylinder rotary compressor which can enhance the reliability by improving the compression efficiency/mechanical efficiency. The bearings are fixed on the inner wall of the closed container, the cylinders are fixed to the bearings, and a gap is formed between the respective cylinders and the inner wall of the closed container. The design with the relatively large internal volume of the closed container is possible, and the reliability can be enhanced. Further, improvement in the compression efficiency and the mechanical efficiency can be achieved with the compact multi-cylinder rotary compression element.

2 Claims, 6 Drawing Sheets

MULTI-CYLINDER ROTARY COMPRESSOR

The subject application is a division of Ser. No. 09/935,815 filed Aug. 23, 2001, now U.S. Pat. No. 6,524,086, granted Feb. 25, 2003, which is a continuation and division of application Ser. No. 09/632,877 filed Aug. 4, 2000. now U.S. Pat. No. 6,336,799. granted Jan. 8, 2002.

BACKGROUND OF THE INVENTION

1. Field of the Invention

The present invention relates to a multi-cylinder rotary compressor mounted in, for example, an air conditioner or a freezing machine.

2. Description of the Prior Art

This kind of conventional multi-cylinder rotary compressor accommodates in a closed container an electric element and a rotary compression element, and the rotary compression element comprises: an intermediate partition plate; first and second cylinders provided on both sides of the intermediate partition plate; a rotating shaft which has eccentric portions whose rotating angles are shifted from each other 180 degrees and is connected to the electric element; rollers respectively fitted to the eccentric portions of the rotating shaft to rotate in the cylinders; and bearings for closing openings of the cylinders.

The respective cylinders are fixed on the inner wall of the closed container, and the bearings are attached to the upper and lower portions of these cylinders. In this case, there is adopted a method using two (a pair of) cylinders employed in a single-cylinder rotary compressor.

However, when two cylinders for use in the single-cylinder rotary compressor are employed as they are, the internal volume of the closed container is restricted and reduction in a quantity of oil or a space volume causes a problem of reliability. As a countermeasure, when two of the thinned cylinders are used, reduction in a compressor output can be a problem.

SUMMARY OF THE INVENTION

In order to solve the above-described technical problems in the prior art, an object of the present invention is to provide a multi-cylinder rotary compressor which can enhance the reliability by improving the compression efficiency/mechanical efficiency.

That is, the present invention provides a multi-cylinder rotary compressor for accommodating in a closed container an electric element and a rotary compression element, the rotary compression element comprising: an intermediate partition plate; first and second cylinders provided on both sides of the intermediate partition plate; a rotating shaft which has eccentric portions whose rotating angles are shifted from each other 180 degrees and is connected to the electric element; rollers fitted to the eccentric portions of the rotating shaft to rotate in the cylinders; and bearings for closing the respective openings of the cylinders, the bearings being fixed on the inner wall of the closed container, the cylinders being fixed to the bearings, a gap being formed between the respective cylinders and the inner wall of the closed container.

According to the present invention, in the multi-cylinder rotary compressor for accommodating in a closed container an electric element and a rotary compression element, the rotary compression element comprising: an intermediate partition plate; first and second cylinders provided on both sides of the intermediate partition plate; a rotating shaft which has eccentric portions whose rotating angles are shifted from each other 180 degrees and is connected to the electric element; rollers fitted to the eccentric portions of the rotating shaft to rotate in the cylinders; and bearings for closing the respective openings of the cylinders, the bearings are fixed on the inner wall of the closed container, and the cylinders are fixed to the bearings. Further, a gap is formed between the respective cylinders and the inner wall of the closed container. Therefore, the design with a relatively large internal volume of the closed container is possible, and the reliability can be enhanced. Moreover, improvement in the compression efficiency and the mechanical efficiency can be achieved with the compact multi-cylinder rotary compression element.

In particular, the compression element can be constituted by using two cylinders each having a diameter which is one size smaller for a single-cylinder rotary compressor, and use of the common parts can result in reduction in the manufacturing cost.

Further, in the multi-cylinder rotary compressor according to the present invention, the rotary compression element comprises: a vane coming into contact with the roller in the cylinder; an insertion hole formed to the cylinder; a springs inserted from the insertion hole into the cylinder to cause the vane to be in contact with the roller, a cover member for closing the opening of the insertion hole on the outer surface side of the cylinder being provided, the cover member being pressed into the cylinder.

According to the present invention, since the cover member for closing the opening of the insertion hole, which is used for inserting the spring causing the vane to be pressed to be in contact with the roller into cylinder, on the outer surface side of the cylinder is pressed into the cylinder, the structure for holding down the cover member for preventing the spring from coming off can be simplified, thereby achieving reduction in cost.

In the multi-cylindrical rotary compressor according to the present invention, the rotary compression element comprises: a vane coming into contact with the roller in the cylinder; an insertion hole formed to the cylinder; and a spring which is inserted from the insertion hole into the cylinder and causing the vane to be pressed against the roller in contact, a solid coiling portion being formed at the outer side end portion of the spring, the solid coiling portion being brought into contact with the inner wall of the closed container.

According to the present invention, since the solid coiling portion is formed at the outer side end portion of the spring for causing the vane to be pressed against the roller in contact and the solid coiling portion are brought into contact with the inner wall of the closed container, the spring can be prevented from coming off without increasing a number of components, thereby achieving considerable reduction in cost.

In the multi-cylinder rotary compressor according to the present invention, the rotary compression element comprises: a vane coming into contact with the roller in the cylinder; an insertion hole formed to the cylinder; and a spring which is inserted from the insertion hole into the cylinder and presses the vane against the roller in contact, a screw is fixed around the opening of the insertion hole, the bearing surface of the screw holding the end portion of the spring.

According to the present invention, since the end portion of the spring for pressing the vane against the roller in contact is held by the bearing surface of the screw fixed around the opening of the insertion hole, the spring can be prevented from coming off by utilizing existing parts, and hence the cost can be greatly reduced. Further, disassembly can be possible by removing the screw, thus improving the maintenance operability.

In addition, the multi-cylinder rotary compressor according to the present invention comprises a plurality of screws.

According to the present invention, since a plurality of screws are provided, the spring can be held down at multiple positions, and the spring can be hence assuredly prevented from coming off.

In the multi-cylinder rotary compressor according to the present invention, the rotary compression element comprises: a vane coming into contact with roller in the cylinder; an insertion hole formed to the cylinder; and a spring which is inserted from the insertion hole into the cylinder and presses the vane against the roller in contact, the relationship between the insertion hole and the spring being set such that the spring can be compressed and bonded in the vicinity of the opening of the insertion hole.

According to the present invention, since the relationship between the spring for pressing the vane against the roller in contact and the insertion hole is set so that the spring is compressed and bonded in the vicinity of the opening of the insertion hole, parts such as a cover or a screw for securing the spring are no longer necessary, and the cost can be greatly reduced.

Additionally, in the multi-cylinder rotary compressor according to the present invention, a spring constant of the spring from a compressed and bonded part thereof to the spring portion on the closed container side is set to be considerably higher than a spring constant from the compressed and bonded part of the spring to the vane side.

According to the present invention, since the spring constant of the spring from the compressed and bonded part thereof to the spring portion on the closed container side is set to be considerably higher than a spring constant of the spring from the compressed and bonded part thereof to the vane side, the spring expands so as to enter the insertion hole, thereby further assuredly preventing the spring from coming off.

DETAILED DESCRIPTION OF THE PREFERRED EMBODIMENTS

Preferred embodiments according to the present invention will now be described in detail with reference to the drawings. It is to be noted that the term screw includes vises and bolts as well as screws.

Figure 1:
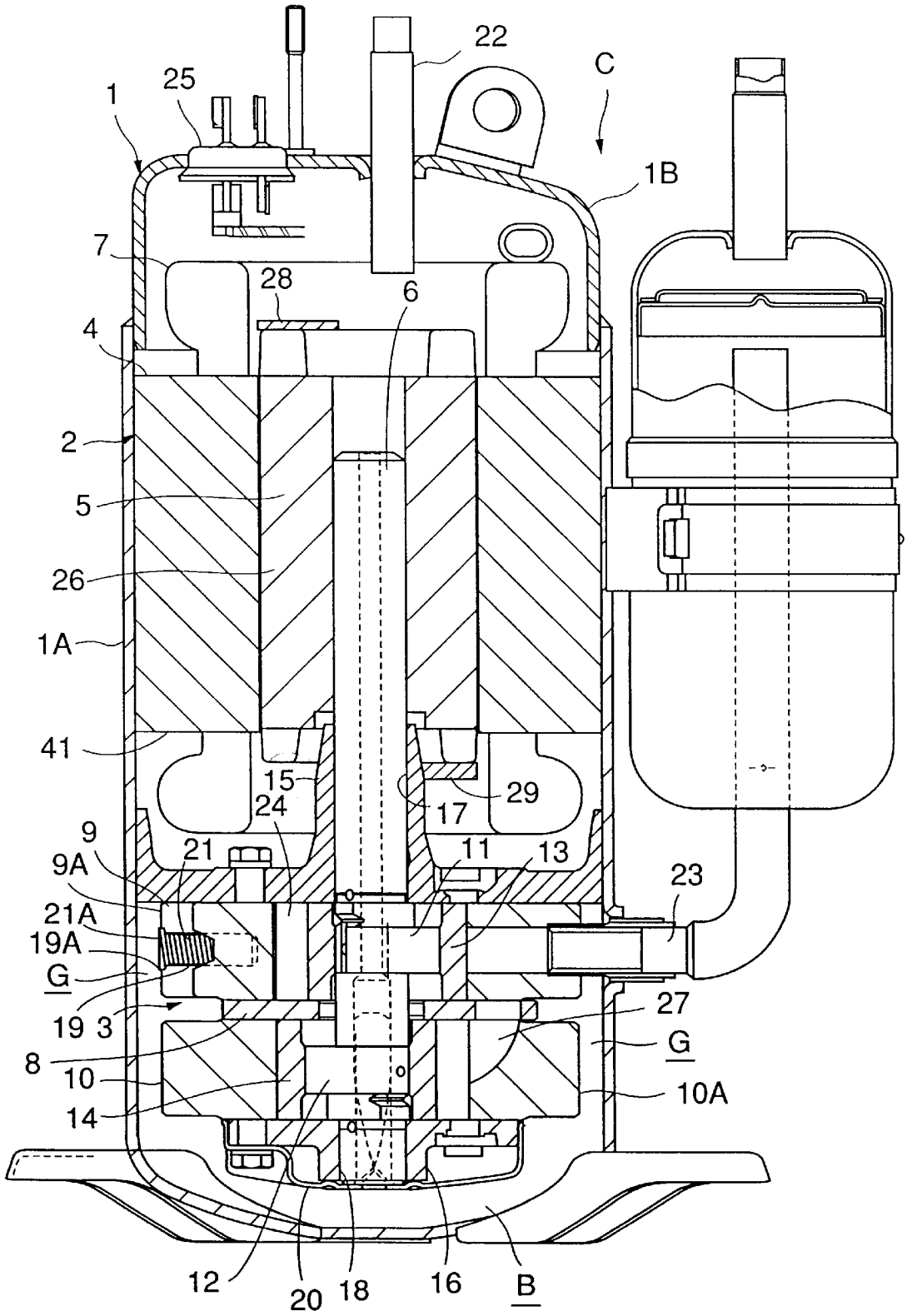
FIG. 1 is a longitudinal side view showing a multi-cylinder rotary compressor according to one embodiment to which the present invention is applied.

FIG. 1 is a longitudinal side sectional view of a multi-cylinder rotary compressor C to which the present invention is applied. In this drawing, reference numeral 1 denotes a cylindrical closed container in which an electric motor 2 is accommodated on the upper side as an electric element and a rotary compression element 3 driven to rotate by the electric motor 2 is housed on the lower side. The closed container 1 has a half-split structure consisting of a cylindrical shell portion 1A whose upper end is opened and an end cap portion 1B for closing the upper end opening of the shell portion 1A. Further, the closed container 1 is constituted by fitting the end cap portion 1B on the shell portion 1A to be sealed by high frequency deposition and the like after housing the electric motor 2 and the compression element in the shell portion 1A. In addition, a bottom portion in the shell portion 1A of the closed container 1 serves as an oil bank B.

The electric motor 2 is a DC brushless motor and constituted by a stator 4 fixed to an inner wall of the closed container 1 and a rotator 5 which is fixed by a rotating shaft 6 that extends in the axial direction of the cylinder of the closed container 1 and is rotatable around the rotating shaft 6 on the inner side of the stator 4. The stator 4 includes a stator core 41 formed by superimposing a plurality of stator iron plates (silicon steel plates) having a substantially donut-like shape and a stator winding (driving coil) 7 for giving a rotating magnetic field to the rotator 5. The outer peripheral surface of the stator core 41 comes into contact with the inner wall of the shell portion 1A of the closed container 1 to fix the electric motor 2.

On the other hand, the rotary compression element 3 is provided with a first rotary cylinder 9 and a second rotary cylinder 10 separated by an intermediate partition plate 8. Eccentric portions 11 and 12 driven to rotate by the rotating shaft 6 are attached to the respective cylinders 9 and 10, and the eccentric positions of these eccentric portions 11 and 12 are shifted from each other 180 degrees.

Reference numerals 13 and 14 denote a first roller and a second roller which rotate in the respective cylinders 9 and 10 by rotation of the eccentric portions 11 and 12. Reference numerals 15 and 16 designate first and second bearings, and the first bearing 15 forms a closed compression space of the cylinder 9 between itself and the intermediate partition plate 8 while the second bearing 16 similarly forms a closed compression space of the cylinder 10 between itself and the intermediate partition plate 8.

An insertion hole 19 drilled inwardly from an outer wall 9A is formed to the cylinder 9, and a coil spring 21 is inserted into the insertion hole 19 from the outside. The spring 21 presses the vane 24 in the cylinder 9 to come into contact with the roller 13. In this example, the spring 21 is fixed to the cylinder 9 by pressing a solid coiling portion 21A formed to the outside end portion into the inner wall of the insertion hole 19 on the inner side of the opening 19A on the outer side of the insertion hole 19.

It is to be noted that the structure of the spring and the vane is similar to that of the cylinder 10. Further, the first bearing 15 and the second bearing 16 include bearing portions 17 and 18 that rotatably pivot the lower portion of the rotating shaft 6.

The first bearing 15 on the upper side is fixed to the inner wall of the shell portion 1A of the closed container 1, and the cylinder 9, the intermediate partition plate 8, the cylinder 10 and the second bearing 16 can be sequentially fixed on the lower side. As the cylinders 9 and 10, two cylinders for a single-cylinder rotary compressor of a class lower than the series of this compressor C are used. (For example, if this compressor has 25 frames, two cylinders for the single-cylinder rotary compressor having 20 frames are used.) Therefore, since its outer diameter becomes small, a gap G is formed between the outer wall 9A or 10A of each cylinder 9 or 10 and the inner wall of the shell portion 1A.

Reference numeral 20 represents a cup muffler which is attached so as to cover the lower side of the second bearing 16. It is to be noted that cylinder 9 communicates with the inside of the closed container 1 above the bearing 15 through a non-illustrated communication hole provided to the bearing 15. Further, cylinder 10 likewise communicates with the cup muffler 20 through a non-illustrated communication hole provided to the second bearing 16, and the cup muffler 20 on the lower side communicates with the inside of the closed container 1 above the bearing 15 via a non-illustrated through hole piercing the cylinders 9 and 10 and the intermediate partition plate 8.

Reference numeral 22 denotes a discharge pipe provided on the top of the closed container 1, and 23, a suction pipe connected to the cylinders 9 and 10 (connected to the cylinder 10 through a passage 27). Further, reference numeral 25 designates a closed terminal which supplies power from the outside of the closed container 1 to the stator winding 7 of the stator 4 (a lead wire connecting the closed terminal 25 to the stator winding 7 is not shown).

On the other hand, reference numeral 26 represents a rotator core of the rotator 5 which is obtained by superimposing multiple rotator iron plates punched out from an electromagnetic steel plate having a thickness of 0.3 mm to 0.7 mm in a predetermined shape and caulking them to be integrally layered. Reference numerals 28 and 29 denote balance weights attached to the upper and lower portions of the rotator core 26.

With such a structure, when the stator winding 7 of the stator 4 of the electric motor 2 is energized, the rotating magnetic field is formed to rotate the rotator 5. Rotation of the rotator 5 causes eccentric rotation of the rollers 13 and 14 in the cylinders 9 and 10 through the rotating shaft 6, and the intake gas absorbed from the suction pipe 23 is compressed.

The compressed high pressure gas is emitted from the upper cylinder 9 into the cup muffler 1 through the communication hole. On the other hand, the gas is emitted from the cylinder 10 into the cup muffler 20 through the communication hole and similarly discharged into the closed container 1 via the through hole.

The gas discharged into the closed container 1 passes the electric motor 2 to be discharged from the discharge pipe 22 to the outside. Further, the oil is separated and passes the space between the electric motor 2 and the closed container 1 to be fed back to the oil bank B.

Here, as the respective cylinders 9 and 10, cylinders with a small diameter for use in a compressor of a lower class are used, and a gap G is formed between the respective cylinders 9 and 10 and the inner wall of the closed container 1. This allows the design that the inner volume of the closed container 1 such as a volume of the oil bank B is relatively large. As a result, the reliability can be enhanced, and the compression efficiency and the mechanical efficiency can be improved with the compact compression element 3.

In particular, since two cylinders for a single-cylinder rotary compressor with a diameter which is one size smaller are used to constitute the compression element 3, realization of commonality of parts can greatly reduce the production cost.

Figure 2:
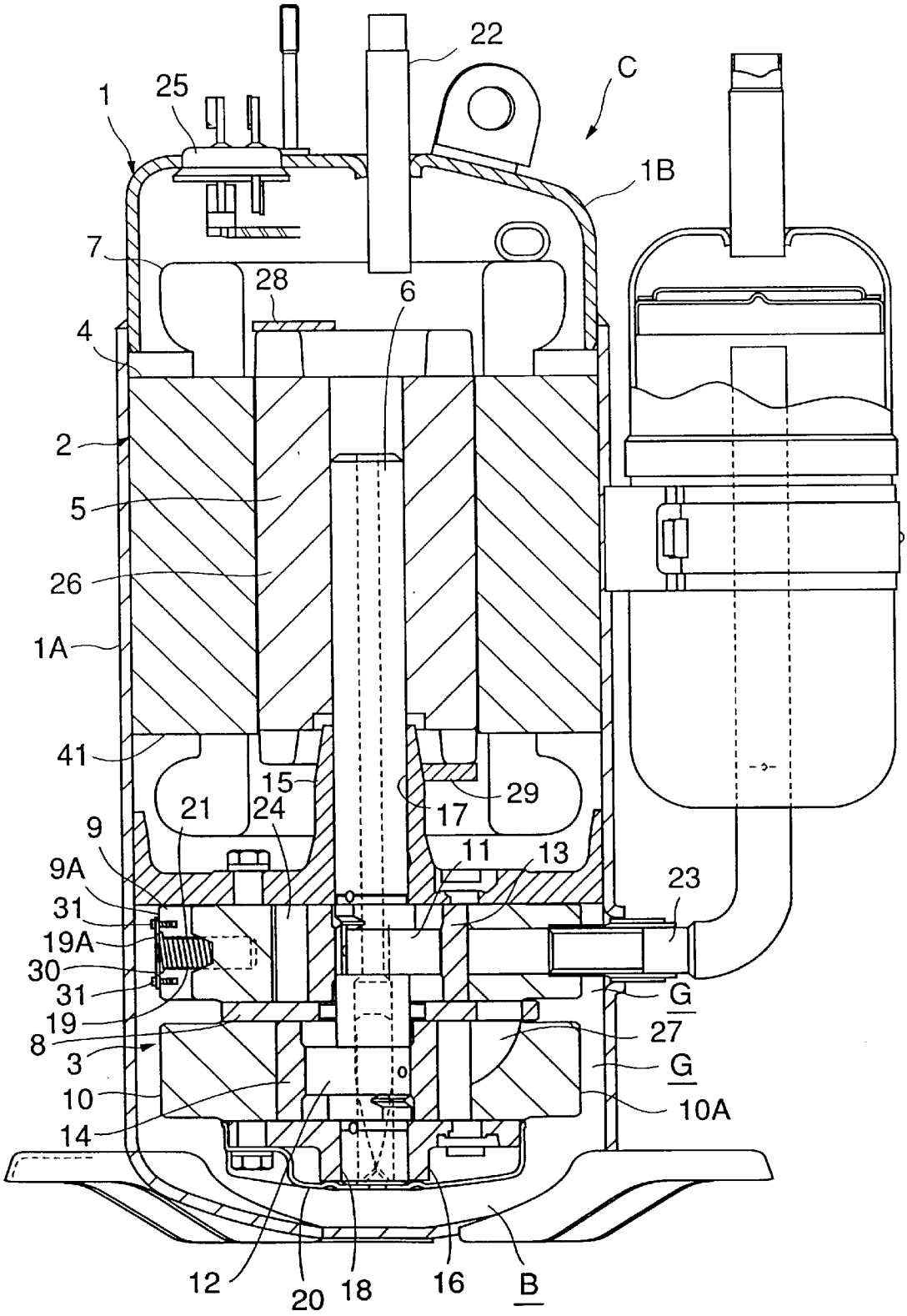
FIG. 2 is a longitudinal side view showing a multi-cylinder rotary compressor according to another embodiment to which the present invention is applied.

FIG. 2 shows another embodiment of the multi-cylinder rotary compressor according to the present invention. It is to be noted that parts denoted by like reference numerals demonstrate parts having like or similar functions in this drawing. In the case of the embodiment shown in FIG. 1, the spring 21 fixes the solid coiling portion 21A formed on the outer side end to the cylinder 9 by pressing it into the inner wall of the insertion hole 19 on the inner side of the opening 19A on the outer side of the insertion hole 19, the spring 21 may come off the opening 19A of the insertion hole 19.

As a countermeasure, a cover plate 30 having a curved-plate-like shape is attached to the cylinder 9 (10) by a screw 31 to close the opening 19A of the insertion hole 19, thereby preventing the spring 21 from coming off.

Figure 3:
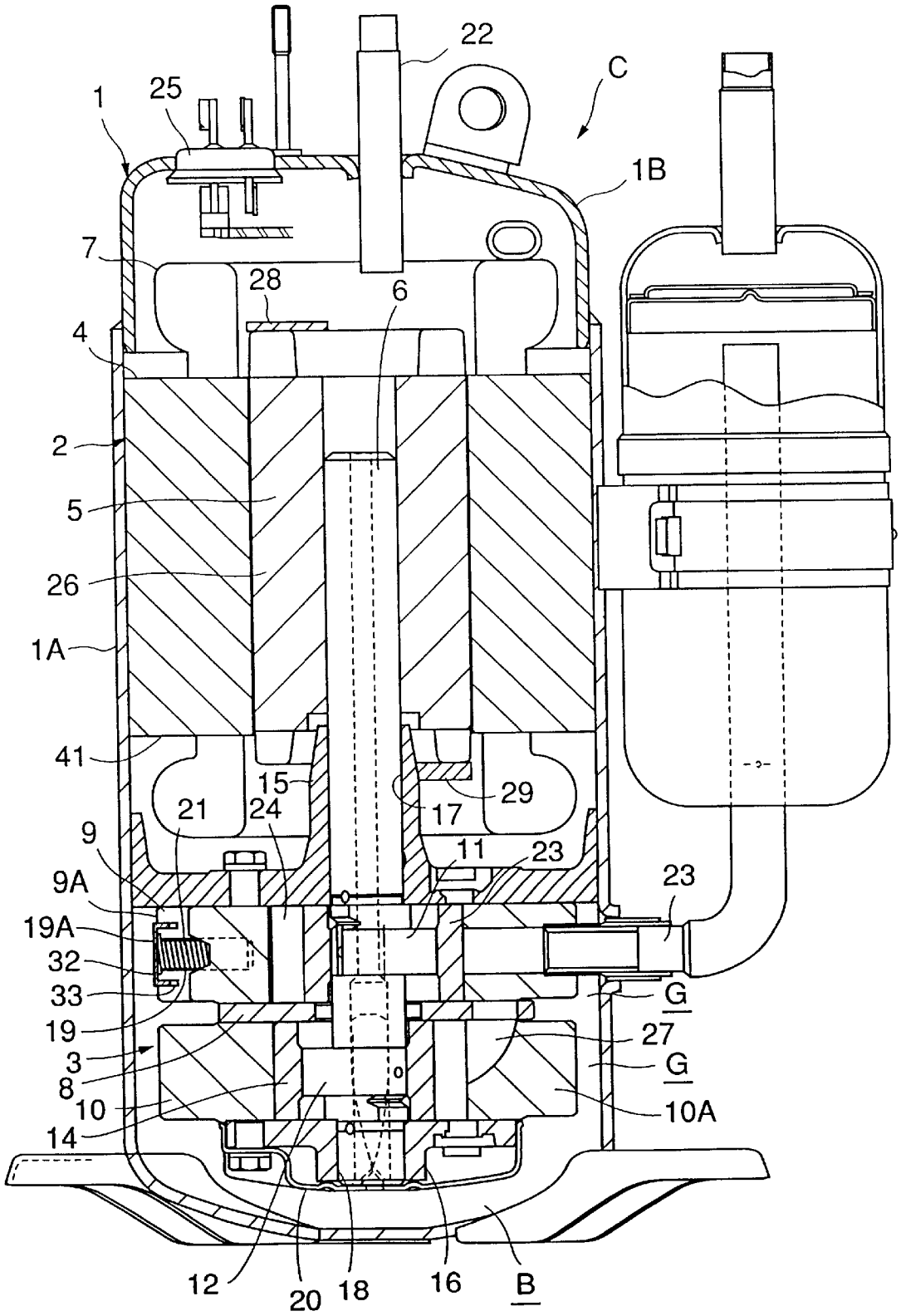
FIG. 3 is a longitudinal side view showing a multi-cylinder rotary compressor according to still another embodiment to which the present invention is applied.

FIG. 3 shows still another embodiment of the multi-cylinder rotary compressor C according to the present invention. It is to be noted that parts denoted by like reference numerals in FIGS. 1 and 2 demonstrate like or similar functions in this drawing. In case of the embodiment illustrated in FIG. 2, the opening 19A of the insertion hole 19 is closed by the cover plate 30 and the cover plate 30 is attached to the cylinder 9 (10) by the screw 31 in order to prevent the spring 21 from protruding, but a cap like cover member 32 is used instead of the cover plate 30 in this embodiment.

On the other hand, an annular groove 33 is formed to the outer side wall 9A (10A) of the cylinder 9 (10) around the opening 19A. The edge portion of the cover member 32 is pressed into the groove 33 with the opening 19A of the insertion hole 19 being closed by the cover member 32 so that the cover member 32 is attached to the cylinder 9 (10).

According to this arrangement, the structure for holding down the cover member 32 for preventing the spring 21 from coming off can be simplified, thereby achieving reduction in the cost.

Figure 4:
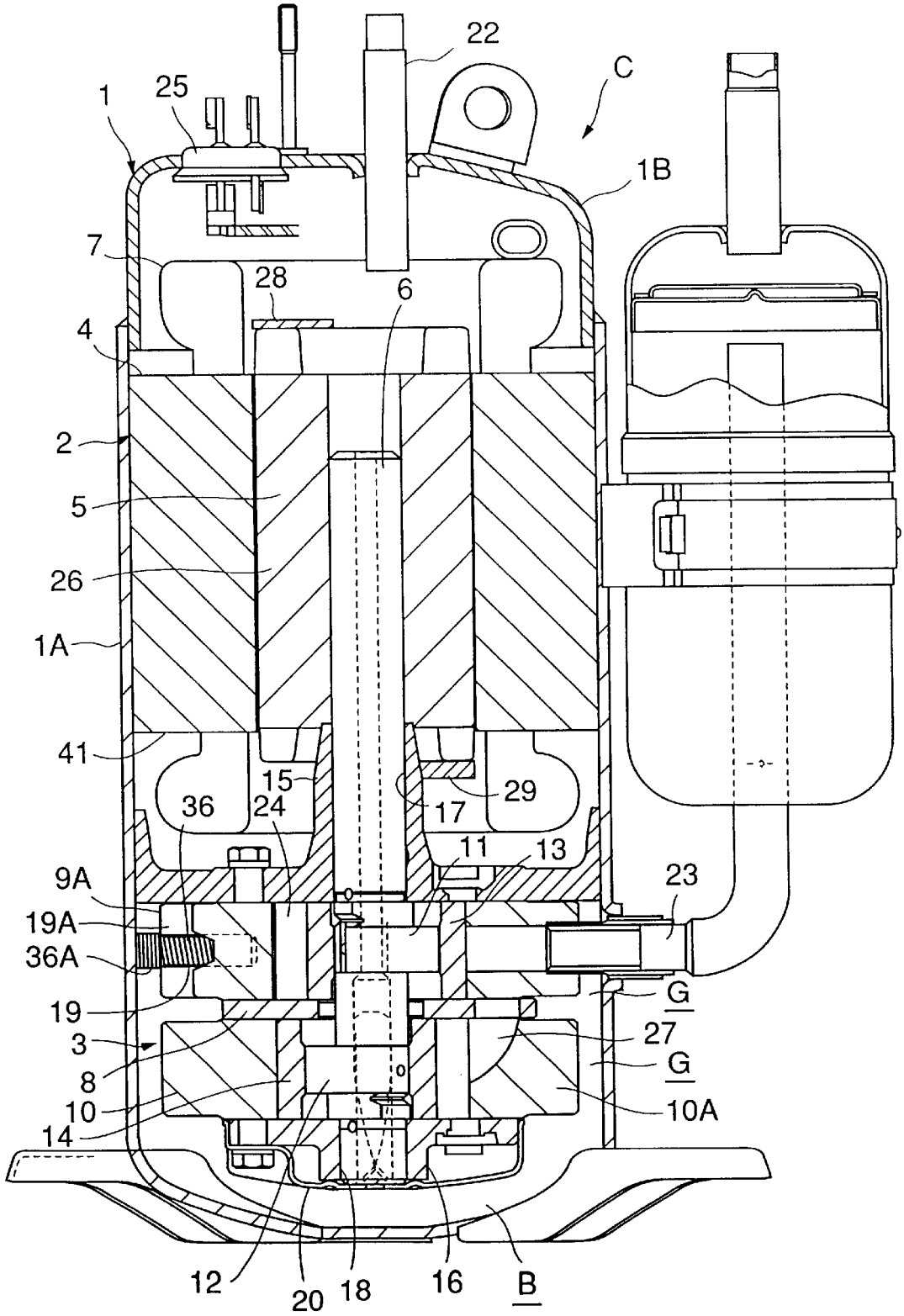
FIG. 4 is a longitudinal side view showing a multi-cylinder rotary compressor according to yet another embodiment to which the present invention is applied.

FIG. 4 shows yet another embodiment of the multi-cylinder rotary compressor C according to the present invention. It is to be noted that parts denoted by like reference numerals in FIGS. 1, 2 and 3 demonstrate like or similar functions in this drawing. The spring 36 in this example has the solid coiling portion 36A formed at the outer side end portion thereof extending outwards beyond the spring 21, and this solid coiling portion 36A directly comes into contact with the inner wall of the shell portion 1A of the closed container 1 from the opening 19A of the insertion hole 19. It is to be noted that the coiling portions of the solid coiling portion 36A are substantially appressed to each other.

With this arrangement, since the spring 36 can be prevented from coming off from the insertion hole 19 without using the cover plate or the cover member, the cost can be greatly reduced by decreasing a number of parts and simplifying the cylinder structure.

Figure 5:
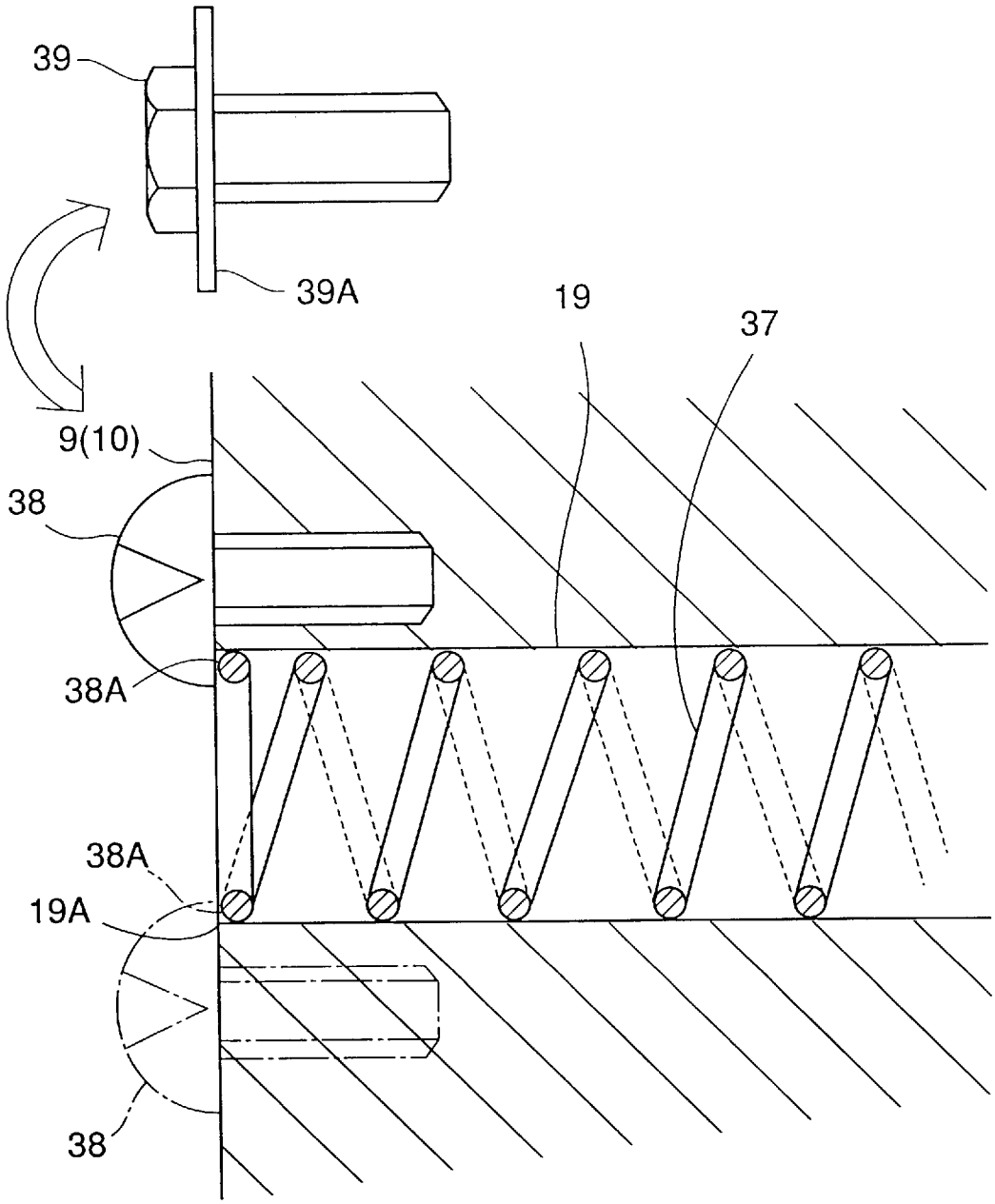
FIG. 5 is an enlarged longitudinal side view showing an insertion hole portion of a cylinder of a multi-cylinder rotary compressor according to a further embodiment to which the present invention is applied.

FIG. 5 shows a further embodiment of the multi-cylinder rotary compressor C according to the present invention. In this drawing, parts denoted by like reference numerals in FIGS. 1, 2, 3 and 4 demonstrate like or similar functions. In this case, a plurality of vises 38 are provided to the cylinder 9 (10) around the opening 19A of the insertion hole 19, and a bearing surface 38A of each of these vises 38 partially extends to the opening 19A. The end portion of the spring 37 on the outer side is held down by the bearing surfaces 38A of these vises 38.

According to this structure, the spring 37 can be prevented from coming off by using the existing parts, thereby greatly reducing the cost. Further, disassembly is also possible by removing the vises 38, and the maintenance operability can be also improved. Moreover, since a plurality of vises 38 are provided, the spring 37 can be held down at multiple positions, thus further assuredly preventing the spring 37 from coming off.

Although two vises 38 (one is indicated by a dashed line) are shown in the above embodiment, one vis 38 may be used. Additionally, a bolt 39 such as shown in FIG. 5 may substitute for the vis 38, and the spring 37 is held down by the bearing surface 39A of the bolt 39 in this case. It is noted that the technique for holding down the spring 37 by the vis 38 or the bolt 39 may be applied to the single-cylinder rotary compressor.

Figure 6:
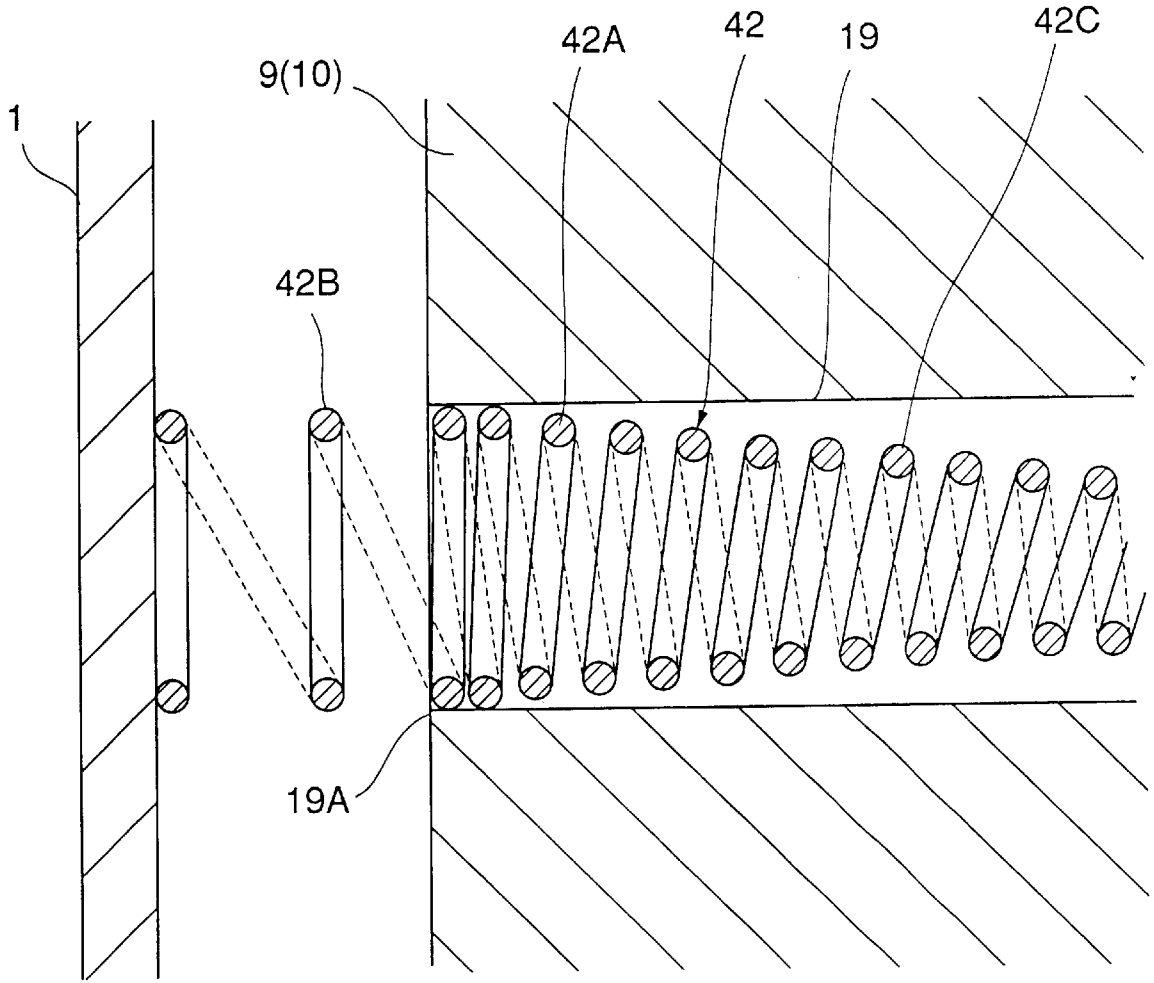
FIG. 6 is an enlarged longitudinal side view showing an insertion hole portion of a cylinder of a multi-cylinder rotary compressor according to a still further embodiment to which the present invention is applied.

FIG. 6 shows a still further embodiment of the multi-cylinder rotary compressor C according to the present invention. It is to be noted that parts denoted by like reference numerals in FIGS. 1, 2, 3 and 4 have like or similar functions in this drawing. In this example, to the spring 42 is formed a compression bonding portion 42A compressed and bonded to the cylinders 9 (10) in the vicinity of the opening 19A of the insertion hole 19, and the spring constant of a portion 42B from the compression bonding portion 42A to the closed container 1 side is set to be higher than the spring constant of a portion 42C from the compression bonding portion 42A to the vane side (for example, the spring constant is two-fold).

With such an arrangement, since the spring 42 is held down at the compression bonding portion 42A of the spring 42, parts such as a cover or a spring are no longer necessary, thereby greatly reducing the cost. Further, since the spring constant of the portion 42B from the compression bonding portion 42A of the spring 42 to the closed container 1 side is set to be considerably higher than the spring constant of the portion 42C from the compression bonding portion 42A to the vane side, the spring 42 expands so as to enter the insertion hole 19 even if the compression bonding portion 42A comes off, thus further assuredly preventing the spring 42 from coming off.

According to the present invention described above, in the multi-cylinder rotary compressor for accommodating in a closed container an electric element and a rotary compression element, the rotary compression element comprising: an intermediate partition wall; first and second cylinders provided on both sides of the intermediate partition plate; a rotating shaft which has eccentric portions whose rotating angles are shifted from each other 180 degrees and is connected to the electric element; rollers which are respectively fitted to the eccentric portions of the rotating shaft and rotate in the cylinders; and bearings for closing respective openings of the cylinders, the bearings are fixed on the inner wall of the closed container, the cylinders are fixed to the bearings and a gap is formed between the respective cylinders and the inner wall of the closed container. Therefore, the design with a relatively large internal volume of the closed container is possible, and the reliability is enhanced. Further, improvement in the compression efficiency and the mechanical efficiency can be achieved with the compact multi-cylindrical rotary compression element.

In particular, the compression element can be formed by using two cylinders for a single cylinder rotary compressor with a diameter which is one size smaller, and realization of commonality of parts can greatly reduce the production cost.

In addition, since the cover member for closing the opening of the insertion hole on the cylinder outer surface side, into which insertion hole the spring for causing the vane to come in to contact with the roller by pressure is inserted, is pressed into the cylinder, the structure for holding down the cover member for preventing the spring from coming off can be simplified, thereby reducing the cost.

Moreover, the solid coiling portion is formed on the outer side end portion of the spring for causing the vane to come into contact with the roller by pressure so that the solid coiling portion is brought into contact with the inner wall of the closed container. Therefore, the spring can be prevented from coming off without increasing a number of parts, thus considerably reducing the cost.

Further, since the end portion of the spring for causing the vane to come into contact with the roller by pressure can be held down by the bearing surface of the screw provided around the opening portion of the insertion hole, the spring can be prevented from coming off by utilizing the existing parts, thus significantly reducing the cost. Furthermore, the disassembly is also possible by removing the screw, which improves the maintenance operability.

Additionally, since a plurality of screws are provided, the spring can be held down at multiple positions, thereby assuredly preventing the spring from falling.

Moreover, since the relationship between the insertion hole and the spring for causing the vane to come into contact with the roller by pressure is set so that the spring can be compressed and bonded in the vicinity of the opening of the insertion hole, parts such as a cover or a screw for holding down the spring are no longer necessary, thus greatly reducing the cost.

In addition, since the spring constant of a portion at which the spring is applied to the spring portion on the closed container side is set so as to be much higher than the spring constant of a portion at which the spring is applied to the vane side, the spring expands so as to enter the insertion hole even if the applied portion comes off, which further assuredly prevents the spring from falling.

What is claimed is:

1. A vertical multi-cylinder rotary compressor for use in a closed container having an electric element in the upper portion of said closed container and a rotary compression element in the lower portion of said closed container, said rotary compression element comprising:

an intermediate partition plate;

a first and a second cylinder provided on respective opposite sides of said intermediate partition plate;

a rotating a shaft having eccentric portions whose rotating angles are shifted from each other by 180 degrees and being connected to said electric element;

a roller respectively fitted to each said eccentric portion of said rotating shaft so as to rotate in its respective cylinder; and a bearing on a side of each cylinder opposite said intermediate partition plate for closing the respective opening of each of said cylinders, one of said bearings being fixed on an inner wall of said closed container, said cylinders being fixed to said bearings with a gap between both of said cylinders and the inner wall of said closed container;

a vane for contacting said roller in said each cylinder;

an insertion hole formed in a said cylinder; and a spring inserted in said insertion hole in a said cylinder, said spring having a first portion in the vicinity of the opening of said insertion hole and being in direct contact with the said cylinder such that said insertion hole fixes the spring to said cylinder in said insertion hole and a second portion that engages said vane to cause said vane to come into contact with said roller by pressure; wherein said spring has a third portion extending from said insertion hole opening to engage the inner w ill of said closed container side, said spring third portion having a spring constant that is greater than the spring constant of said second spring portion which engages said vane.

2. The multi-cylinder rotary compressor according to claim 1, wherein said first portion of said spring is compressed against said cylinder in said insertion hole to fix said spring to said cylinder.

* * * * *